United States Patent [19]

Calienes

[11] 4,177,634

[45] Dec. 11, 1979

[54] MULTI-REFLECTION CLOCK

[76] Inventor: Miguel Calienes, 8370 SW. 39th St., Miami, Fla. 33155

[21] Appl. No.: 834,846

[22] Filed: Sep. 20, 1977

[51] Int. Cl.[2] ..... G04B 19/30; G04B 19/06

[52] U.S. Cl. ..... 58/50 R; 58/127 R

[58] Field of Search ..... 58/45, 50 R, 127 R; 362/23-30; 40/427-431, 540, 564, 581-583

[56] References Cited

U.S. PATENT DOCUMENTS

| | | | |
|---|---|---|---|
| 322,375 | 7/1885 | Heysinger | 58/50 R |
| 2,132,474 | 10/1938 | Holm | 58/50 R |

*Primary Examiner*—Edith S. Jackmon

*Attorney, Agent, or Firm*—Salvatore G. Militana

[57] ABSTRACT

A multi-reflection clock having a two way mirror mounted over the face of the clock, a one way mirror as the face of the clock with the reflecting surface of the one way mirror on the rear side of the face of the clock and sources of light arranged in a circle between the two mirrors whereby reflections of the sources of light appear to an observer in a plurality of substantially symmetrically disposed lines about the clock converging together toward the rear of the clock.

2 Claims, 6 Drawing Figures

MULTI-REFLECTION CLOCK

BACKGROUND OF THE INVENTION

1. Field of the Invention

This invention relates to clocks and is more particularly directed to a clock having a plurality of mirrors and sources of light for producing a plurality of lines of light sources that converge together in the direction toward the rear of the clock.

2. Description of the Prior Art

At the present time the conventional clocks are provided with a transparent or translucent pane and a light source to permit an observer to be able to see the position of the clock hands in determining the time. None of these clocks use mirrors for the purpose of reflecting the markings on the face of the clock in order to more readily determine the time indicated by the clock as well as projecting same to the observer in any esthetically pleasing picture.

SUMMARY OF THE INVENTION

Therefore, a principal object of the present invention is to provide a clock with a plurality of mirrors that cause the numerals of a clock to appear in symmetrically disposed converging lines toward the rear of the clock for readily determining the time and for the esthetic effect of same.

Another object of the present invention is to provide a clock with a one way mirror as the face of the clock and a two way mirror in front of the clock, whereby an observer viewing the clock will see symmetrically disposed rows of images, numerals or letters, disposed about the clock and converging together towards the rear of the clock.

With these and other objects in view, the invention will be best understood from a consideration of the following detailed description taken in connection with the accompanying drawings forming a part of this specification, with the understanding, however, that the invention is not confined to any strict conformity with the showing of the drawings but may be changed or modified so long as such changes or modifications mark no material departure from the salient features of the invention as expressed in the appended claims.

Figure 1:
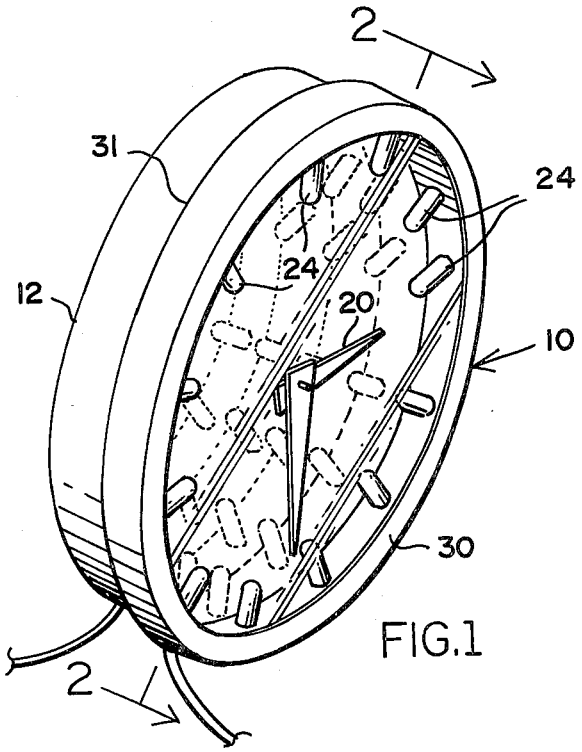
FIG. 1 is a perspective view of a multi-reflection clock constructed in accordance with my invention.

Referring to the drawings wherein like numerals are used to designate similar parts throughout the several views, the numeral 10 refers to my multi-reflection clock consisting of a shallow cylindrical casing —C— having a back wall 11, side walls 12 and 13 joined by a shoulder wall portion 14. Mounted in the casing —C— and engaging the shoulder wall portion 14 is a one-way mirror 15 having its reflecting surface or coating 16 on the rear surface thereof. At the center of the mirror 15 is an opening 17 for receiving the shaft 18 of a motor 19 mounted on the rear of the mirror 15. Mounted on the free end of the shaft 18 in the conventional manner are the hour and minute hands 20 and 21 of the clock.

Abutting against the one way mirror 15 is the side wall 22 of a light supporting collar —L— having a flange portion 23 at its outer periphery. Mounted along the collar —L— on the inside of the wall 22 is a plurality of lamps 24, twelve in number and positioned in the same manner as the hour numbers on a conventional clock.

Wires 25 and 26 that extend from the motor 19 and lamps 24 are connected together as at 33 with further wires 28 extending therefrom through opening 29 in the casing wall 12 to a source of electricity (not shown).

A two way mirror 27 which is translucent or semi-transparent and having its reflecting surface 32 on the inside of the casing —M— is mounted on the front portion of the casing —C— engaging the flange 23 and held in position thereon by the flange portion 30 of a cover 31.

As best shown by FIG. 1 when the lamps 24 are energized, an observer positioned before the clock 10 will see a plurality of images of the lamps 24 in straight alignment with the actual lamps 24 and appearing to converge together at the rear of the clock 10. The reflecting surfaces 16 and 32 of the one way mirror 15 and two way mirror 27 reflect back and forth ad infinitum, the images of the lighted lamps 24. Since the observer can see through the two way mirror 27, he will see the many images in a straight row which appear to converge and would appear to meet together at infinity. These lines of images which represent the hours of a clock are readily discernible and are attractive to the eyes of an observer.

Figure 4:
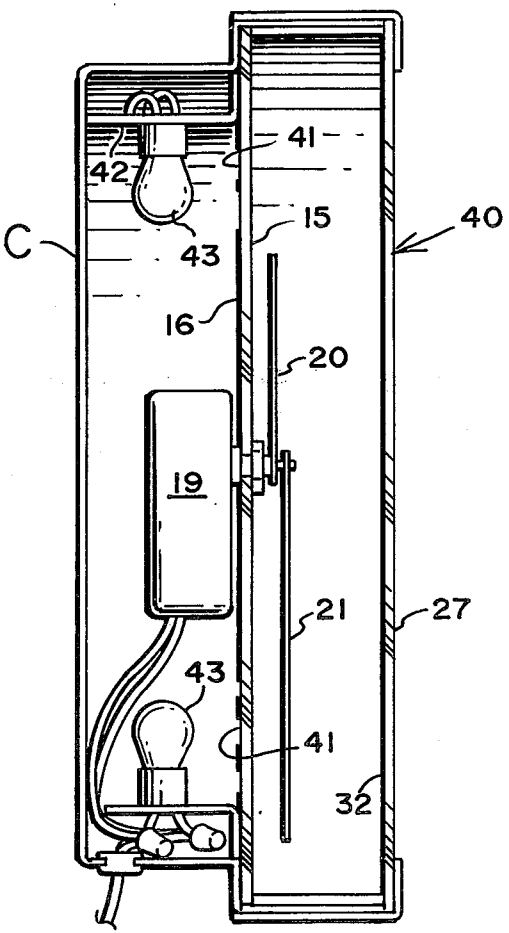
FIG. 4 is a cross sectional view similar to FIG. 2 of an alternate construction of my multi-reflection clock.
Figure 2:
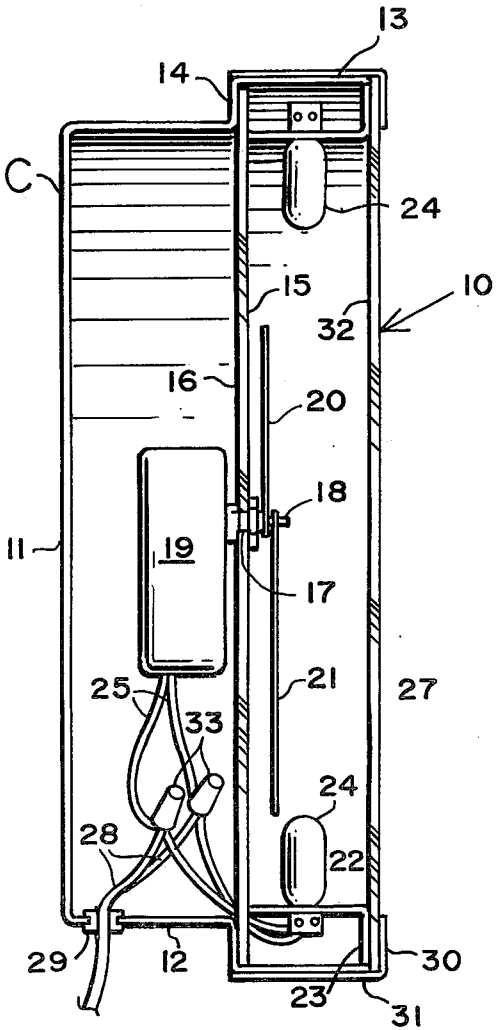
FIG. 2 is a cross sectional view taken along the line 2—2 of FIG. 1.

In my alternate structure shown by FIG. 4, I provide a multi-reflection clock 40 that is identical with the structure of the clock 10 except for the following; namely, instead of having twelve lamps 24, I provide the one way mirror 15 with twelve openings 41 arranged in a circle and representing numerals or letters for advertising in the same manner as numerals on a conventional clock. Within the casing —C— and positioned behind the one way mirror 15 is a lamp supporting collar 42 having a plurality of lamps 43 mounted thereon, the lamps 43 and motor 19 being connected by wires together and to a source of electricity as described hereinabove. The images seen by an observer when looking at the clock 40 will be the images of the numerals in the same straight alignment about the face of the clock 40 in much the same manner as the observer viewed the images of the lamps 24 in FIGS. 1 and 2.

Figure 5:
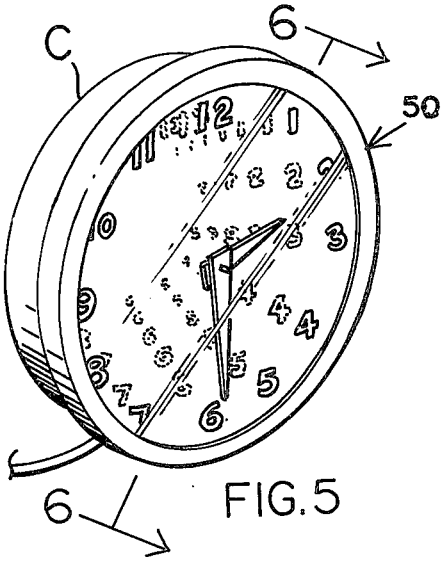
FIG. 5 is a perspective view of a still further alternate construction of my multi-reflection clock.
Figure 3:
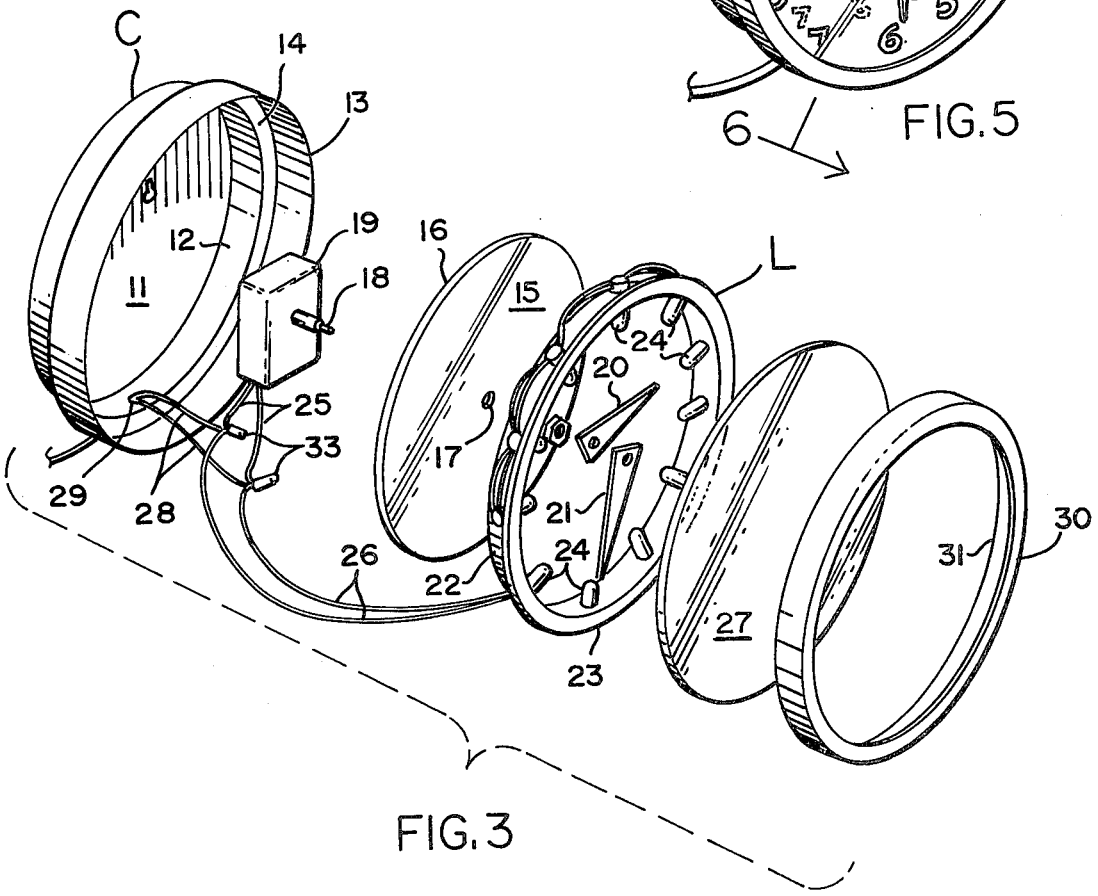
FIG. 3 is an exploded view.
Figure 6:
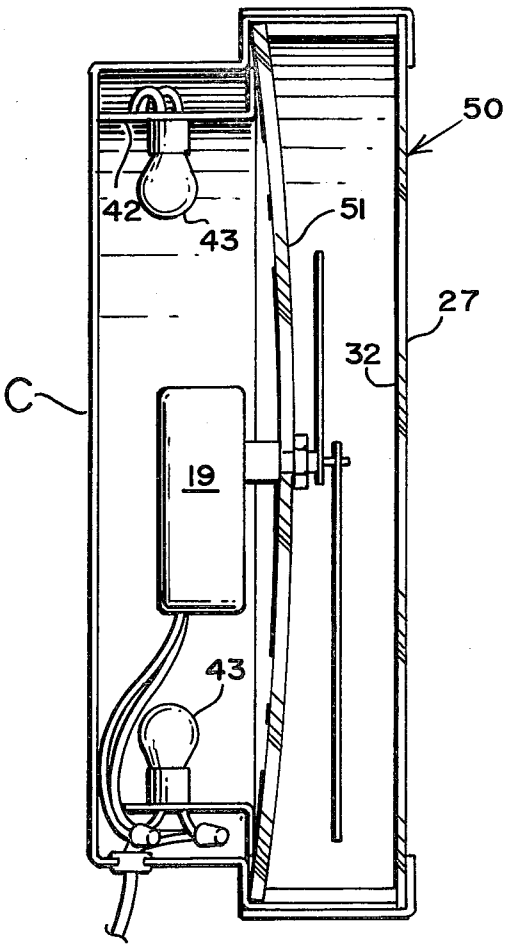
FIG. 6 is a cross sectional view taken along the line 6—6 of FIG. 5.

In my alternate clock 50 shown by FIGS. 5 and 6, the structure is identical with that of FIG. 4 except that the one way mirror 51 is convex rather than flat as shown by FIG. 4. The images being observed by a person looking at the clock 50 will be found to form arcuate rows that appear to converge at the rear portion of the clock 50 as best shown by FIG. 5.

What I claim as new and desire to secure by Letters Patent is:

1. A multi-reflection clock comprising a housing, a one way mirror mounted in said housing, said mirror having a reflecting surface positioned on the rear surface thereof, clock means mounted on said mirror and having minute and hour hands positioned before said front surface of said mirror, a two way mirror mounted on said housing adjacent to and in spaced relation to said front surface of said one way mirror, said one way mirror being convex in shape facing in the direction of said two way mirror and light producing means mounted on said housing whereby substantially innumerable images representing the numerals of a clock are reflected between said mirrors and an observer viewing said clock will see said images symmetrically disposed about said clock, in arcuate alignment and converging together in the direction of the rear of said clock.

2. The structure as recited by claim 1 wherein openings are formed about in a circle on said one way mirror representing the hour indications on a clock and said light producing means being mounted in the rear portion of said housing adjacent said reflecting surface of said one way mirror.

* * * * *